US005887940A

United States Patent [19]

Anderson et al.

[11] Patent Number: 5,887,940

[45] Date of Patent: Mar. 30, 1999

[54] CHAIR ATTACHED TRAY ASSEMBLY

[76] Inventors: Richard B. Anderson; Jeffrey A. Michels, both of 11645 Seneca Dr., Warren, Mich. 48093

[21] Appl. No.: 65,337

[22] Filed: Apr. 23, 1998

[51] Int. Cl.[6] ..... A47B 39/00

[52] U.S. Cl. ..... 297/135; 297/188.18; 108/157.11

[58] Field of Search ..... 297/135, 160, 297/153, 170, 174, 188.18, 188.2, 188.21; 403/381; 108/143, 153.1, 50.14, 157.11, 49, 42; 248/309.1, 310, 311.2, 314, 316.1, 226.11, 228.6, 231.71

[56] References Cited

U.S. PATENT DOCUMENTS

| | | | |
|---|---|---|---|
| 881,727 | 3/1908 | Shurtz . | |
| 1,989,974 | 2/1935 | Elias . | |
| 2,797,973 | 7/1957 | Culpepper | 297/135 X |
| 2,804,126 | 8/1957 | Palmer | 297/160 |
| 2,867,401 | 1/1959 | Sheahan | 297/135 X |
| 3,166,354 | 1/1965 | Sorensen | 297/135 X |
| 3,586,368 | 6/1971 | Guild | 297/135 |
| 3,712,669 | 1/1973 | Cates . | |
| 3,894,496 | 7/1975 | Phillips et al. | 297/135 X |
| 4,125,338 | 11/1978 | Lew . | |
| 4,372,605 | 2/1983 | Cervantes . | |
| 4,662,676 | 5/1987 | Havelock | 297/160 |
| 4,867,506 | 9/1989 | Chavez | 297/153 X |
| 4,941,633 | 7/1990 | Walker et al. . | |
| 4,997,156 | 3/1991 | Allen . | |
| 5,170,720 | 12/1992 | Scheurer | 297/135 X |
| 5,238,212 | 8/1993 | Dechellis . | |
| 5,295,650 | 3/1994 | Brandt . | |
| 5,499,886 | 3/1996 | Short et al. . | |
| 5,570,588 | 11/1996 | Lowe . | |
| 5,586,804 | 12/1996 | Burroughs . | |
| 5,599,037 | 2/1997 | Spickler . | |
| 5,649,737 | 7/1997 | Behnke | 297/160 X |

*Primary Examiner*—Milton Nelson, Jr.
*Attorney, Agent, or Firm*—Kenneth L Tolar

[57] ABSTRACT

A tray assembly uniquely configured to be removably attached to a chair armrest such as that of a beauty salon includes a U-shaped clamp having a pair of parallel sidewalls and an end wall therebetween. A sidewall has an aperture for threadedly receiving a bolt allowing the clamp to be quickly attached to the chair arm rest. The opposing sidewall and the end wall each have an elongated, substantially wedge shaped groove for slidably receiving a tongue on the accompanying tray member. The tray member includes a substantially rectangular support surface having four peripheral edges with an elongated portion integrally extending from an edge thereof. On the upper side of the support surface is a substantially rectangular recessed portion with one or more beverage receptacles therein. The lower side has an elongated, wedge shaped tongue slidably received within either of the grooves on the clamp. The beverage receptacles have one or more freezable gel packs removably received therein for maintaining a beverage at a substantially constant temperature.

9 Claims, 1 Drawing Sheet

CHAIR ATTACHED TRAY ASSEMBLY

BACKGROUND OF THE INVENTION

The present invention relates to a multi-purpose tray for supporting a beverage and similar items particularly designed to be removably attached to the arm rest of a beautician's chair.

DESCRIPTION OF THE PRIOR ART

A beauty salon customer must often remain seated in a beautician's chair for extended periods of time. Accordingly, to entertain one's self, the customer often consumes beverages, reads books and performs similar tasks while seated in the chair. Performing such activities in a chair is tedious and awkward since the customer must grasp the items at all times. Accordingly, there is currently a need for a device which may be quickly and easily attached to a salon chair for allowing a customer to conveniently support items such as beverages, books and newspapers within reach.

Numerous tray assemblies and beverage holders exist in the prior art. However, none of these devices are specifically designed to address the above described problem nor do they have the unique attachment means according to the present invention that allows the tray to be quickly attached to a chair arm rest. For example, U.S. Pat. No. 5,586,804 issued to Burroughs relates to a beverage holder removably attached to a folding chair. The device includes a base connected to the bottom surface of a chair and a container holder member having a circular disc pivotably mounted to the base using a fastener means.

U.S. Pat. No. 4,997,156 issued to Allen discloses a beverage receptacle holder mountable on tubular chair legs. The device includes a diameter adjustable beverage container connected to a rotatably positionable mounting clamp member. The adjustable receptacle is made from a flexible metal rod.

U.S. Pat. No. 4,372,605 issued to Cervantes relates to a hairdresser chair with a removable tray assembly attached thereto. The box type tray is movable between an extended/usable position to a retracted/stowed position. The tray includes a dividing wall forming two juxtaposed compartments for storing hairdressing articles and is attached to the stanchion portion of a vertically adjustable hairdresser's chair.

U.S. Pat. No. 3,712,669 issued to Cates discloses a beautician's tray attachable to a beautician's chair with an elevating arm. The invention includes means for supporting and elevating the tray comprising a bendable tubular arm mounted to the base of a beautician's chair.

U.S. Pat. No. 1,989,974 issued to Elias relates to an attachable and an adjustable ashtray for chairs. Although chair attached tray assemblies and similar devices exist in the prior art, none of these devices relate to a tray assembly having a slidably attached clamp means allowing the assembly to be quickly and conveniently detached from a chair without removing the clamp means as does the present invention. Accordingly, a plurality of clamp means may be permanently attached to several chairs allowing a tray member to be interchangeably used with a number of different chairs and which may be quickly and conveniently removed for storage. The tray assembly includes one or more beverage receptacles each having a removably attached gel pack therein.

SUMMARY OF THE INVENTION

The present invention relates to a unique tray assembly which may be quickly and easily attached to the arm of a chair designed to retain beverages and similar items thereon. The device comprises a substantially U-shaped clamp including a pair of parallel side walls and an end wall therebetween for surrounding a chair armrest. One sidewall has an aperture for threadedly receiving an attachment means such as a bolt to secure the clamp to the armrest. On the opposing sidewall is an elongated, substantially wedge shaped groove for slidably receiving a substantially wedge shaped tongue on the lower surface of the accompanying tray member. The tongue and groove assembly is sometimes referred to as a dovetail type connector. A similar groove is disposed on the end wall of the U-shaped clamp for vertically mounting the tray member to a side of a chair when the tray member is not in use.

The tray member comprises a substantially rectangular support surface with a planar elongated portion for supporting a user's arm integrally extending therefrom. On an upper side of the support surface is a substantially rectangular recessed portion with one or more circular beverage receptacles therein. Removably received within each beverage receptacle is a gel pack for maintaining a cold beverage at a constant temperature. It is therefore an object of the present invention to provide a tray assembly which may be removably attached to a chair armrest.

It is yet another object of the present invention to provide a tray assembly having a simple, easy to use clamp means slidably removable therefrom.

It is yet another object of the present invention to provide a tray assembly that may be quickly detached from a chair arm rest and stored when not in use.

It is yet another object of the present invention to provide a tray assembly that is simple to use and inexpensive to manufacture.

It is yet another object of the present invention to provide a tray assembly having a plurality of beverage receptacles thereon each containing a freezable gel pack. Other objects, features and advantages of the present invention will become readily apparent from the following detailed description of the preferred embodiment when considered with attached drawings and the appended claims.

DESCRIPTION OF THE PREFERRED EMBODIMENT

Figure 2:
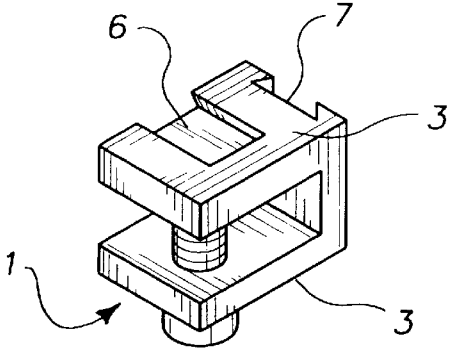
FIG. 2 depicts the clamp means according to the present invention.
Figure 3:
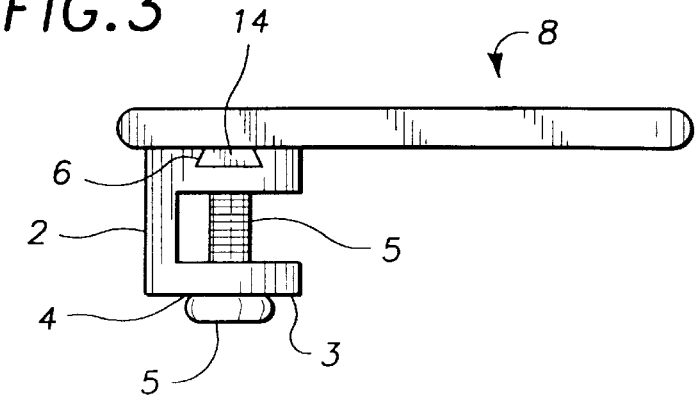
FIG. 3 depicts a side view of the inventive device.
Figure 1:
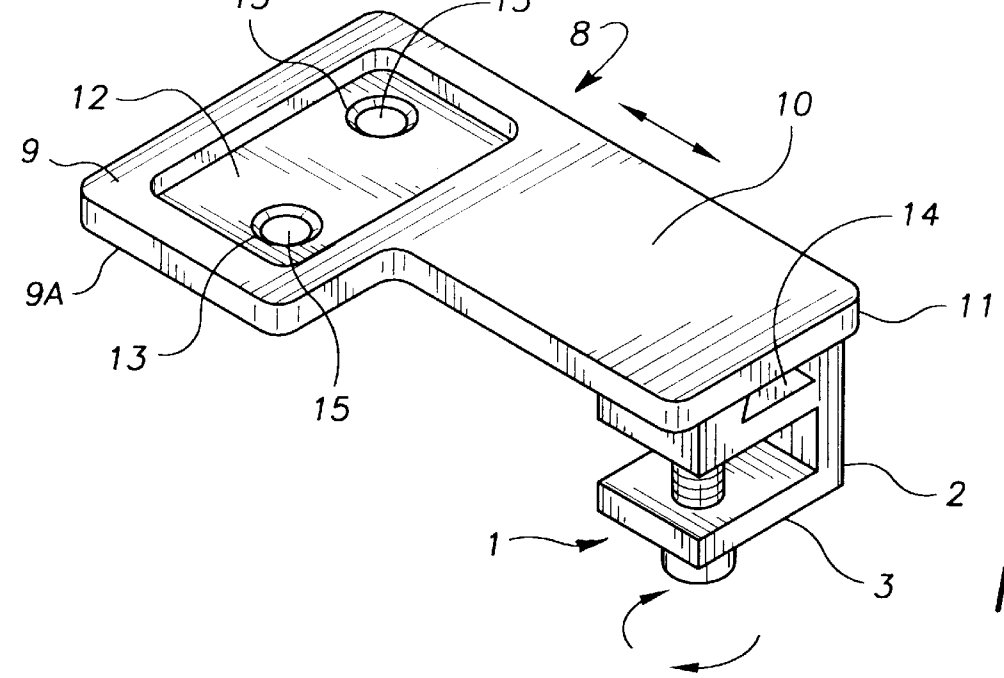
FIG. 1 depicts the inventive device.

Referring now to FIGS. 1 through 3, the present invention relates to a tray assembly which may be quickly and easily attached to a support structure such as a beauty salon chair armrest. A beauty salon chair (not pictured) typically comprises a horizontal seat, a back rest perpendicularly extending therefrom and a pair of opposing arm rests each on an opposing side of the seat. The present invention comprises a substantially U-shaped clamp 1 having an end wall 2 and two spaced parallel side walls 3 perpendicularly depending therefrom. The clamp 1 is dimensioned such that its sidewalls may surround the chair armrest. A first sidewall has an aperture 4 for threadedly receiving an attachment means 5 such as a bolt or nut. Accordingly, the clamp may be quickly attached to the chair armrest by placing the clamp sidewalls on opposing sides of the armrest, preferably with the end wall in a vertical position, and the attachment means 5 is tightened against the armrest.

On the upper surface of the second sidewall is a longitudinal, substantially wedge shaped groove 6 dimensioned to slidably receive a tongue 14 on the lower surface of the tray member described in more detail below. A similar wedge shaped groove 7 is disposed on the clamp end wall 2 for selectively receiving the tongue 14 on the tray member.

The tray member comprises 8 a substantially rectangular, planar support surface 9 having four peripheral edges 9A, an upper side and a lower side. An elongated portion 10 having a terminal edge 11 integrally extends from an edge of the tray member for supporting a user's arm. On the upper side of the support surface 9 is a substantially rectangular recessed portion 12 for receiving and retaining trays and similar items. Disposed within the recessed portion 12 is one or more substantially circular indentions defining beverage receptacles 13 for securely retaining a beverage on the support surface. FIG. 1 depicts two beverage receptacles. However, as will be readily apparent to those skilled in the art, one or more beverage receptacles may be provided without departing from the spirit of the present invention.

Each beverage receptacle 13 has a substantially circular, freezable gel pack 15 removably received therein. The gel packs 15 are of the type generally known in the prior art and typically comprise a plastic sealed container with a freezable material therein. On the bottom side of the elongated portion proximal its terminal edge is an elongated substantially wedge shaped tongue 14 dimensioned to be slidably received within either of the grooves on the U-shaped clamp.

Accordingly, the U-shaped clamp may be quickly attached to a chair armrest by placing the clamp therearound with the armrest received between its sidewalls and the bolt is tightened thereagainst. The tray member may be quickly attached to the clamp by sliding its tongue 14 into a groove 6,7 on the sidewall thereof. When not in use, the tray member may be quickly stored by slidably removing the tray member from the clamp. The clamp may then remain attached to the chair arm rest allowing the tray member to be swiftly and conveniently reattached thereto at a later time. Alternatively, the tray member may be attached to the clamp by sliding the tongue into the groove on the clamp end wall. The tray member is then secured adjacent the armrest in a vertical position allowing the user to freely move into and out of the chair.

The above described device is not to be limited to the exact details described above. Although the device is particularly suitable for use in conjunction with a salon chair, the device may be used in conjunction with any type of chair or other similar support devices. Any number of beverage receptacles may be provided on the tray member. Furthermore, the clamp portion may be attached to a chair armrest with the end wall in either a vertical or horizontal position.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A tray assembly for attaching to a chair arm rest comprising:

a substantially U-shaped clamp having a pair of opposed spaced sidewalls, an end wall disposed therebetween and a first elongated groove on a side wall;

means for attaching said clamp to a support structure;

a substantially planar tray member having an upper and lower surface with an elongated tongue on the lower surface thereof, said tongue dimensioned to be slidably received within said first groove.

2. A device according to claim 1 wherein said means for attaching said clamp to a support structure includes a threaded aperture on a side wall thereof;

a bolt means threadedly received within said aperture for securing said clamp to said support structure.

3. A device according to claim 1 wherein said tray member further includes a substantially rectangular recessed portion on its upper surface with said beverage receptacle received therein.

4. A device according to claim 1 wherein said tray member further includes a planar support surface having four peripheral edges and a planar elongated portion integrally extending from an edge thereof, said planar elongated portion having a terminal edge.

5. A device according to claim 4 wherein said tongue is disposed on the lower surface of said elongated portion proximal its terminal edge.

6. A device according to claim 1 wherein said tray member further includes a substantially circular indention on its upper surface defining a beverage receptacle.

7. A device according to claim 6 further comprising a freezable gel pack removably received within said beverage receptacle.

8. A device according to claim 1 wherein said clamp further includes a second groove on an end wall thereof for selectively receiving said tongue.

9. A device according to claim 8 wherein said first and second grooves and said tongue have a substantially wedge shaped cross-sectional configuration.

* * * * *